US005409638A

United States Patent [19]

Battochi

[11] Patent Number: 5,409,638

[45] Date of Patent: Apr. 25, 1995

[54] ELECTRICALLY CONDUCTIVE LIQUID FOR AN ELECTRICAL STUN GUN

[76] Inventor: Gregory Battochi, 7 Farm La., Suffern, N.Y. 10901

[21] Appl. No.: 123,065

[22] Filed: Sep. 17, 1993

Related U.S. Application Data

[60] Continuation-in-part of Ser. No. 833,148, Mar. 6, 1992, abandoned, which is a division of Ser. No. 313,096, Feb. 21, 1989, Pat. No. 5,103,366, which is a continuation-in-part of Ser. No. 189,463, May 2, 1988.

[51] Int. Cl.[6] ..... H01B 1/02; H01B 1/04

[52] U.S. Cl. ..... 252/503; 252/514; 252/62.2; 106/1.11; 106/1.14; 106/1.19

[58] Field of Search ..... 252/62.2, 502, 521, 252/503, 506, 514; 106/1.11, 1.14, 1.19; 89/1.11; 128/803; 452/59, 60

[56] References Cited

U.S. PATENT DOCUMENTS

| | | | |
|---|---|---|---|
| 4,114,591 | 9/1978 | Nakagawa | 252/186.2 |
| 4,243,994 | 1/1981 | Kobayashi et al. | 346/140 R |
| 4,391,722 | 7/1983 | Schwartz et al. | 252/49.3 |
| 4,726,845 | 2/1988 | Thompson et al. | 106/209 |
| 4,969,873 | 9/1989 | Yagasaki et al. | 252/521 |
| 5,103,366 | 4/1992 | Battochi | 361/232 |
| 5,106,414 | 4/1992 | Kunichika et al. | 106/2 |

OTHER PUBLICATIONS

Hawley, The Condensed Chemical Dictionary, 10th ed., 1981, p. 549.

*Primary Examiner*—Prince Willis, Jr.
*Assistant Examiner*—Alan D. Diamond
*Attorney, Agent, or Firm*—Stanley J. Yavner

[57] ABSTRACT

A new and improved electric stun gun is provided to utilize an electrically conductive liquid mixed in storage containers, which is discharged by use of a compressed gas and activated by a three-position trigger and two liquids combined outside of the discharge point, by means of having one liquid stream negatively charged and the other liquid stream positively charged. A high voltage low current shock is provided to the recipient of the streams of liquid.

2 Claims, 10 Drawing Sheets

ELECTRICALLY CONDUCTIVE LIQUID FOR AN ELECTRICAL STUN GUN

This application is a continuation-in-part of my earlier, filed co-pending application U.S. Ser. No. 07/833,148, filed Mar. 6, 1992, now abandoned, which is a division of Ser. No. 07/313,096, filed Feb. 21, 1989, now U.S. Pat. No. 5,103,366, which is a continuation-in-part of my earlier filed application U.S. Ser. No. 07/189,463, filed May 2, 1988, now abandoned.

BACKGROUND OF THE INVNETION

1. Field of Application

This invention relates to non-lethal weapons; and more particularly, to an electrical stun gun and electrically conductive liquids.

2. Description of the Prior Art

The control of crowds, rioting and other civil disorders poses a problem to the authorities. While the need exists to show strength and control of the situation, the authority does not wish to permanently injure or kill the hostile demonstrators or innocent bystanders. It seems that a means of control which temporarily immobilizes or stuns is the appropriate method to employ.

Many devices to this end are available, for example; rubber bullets, tear gas, mace, clubs, electrical deterrence method and fluid dispensing devices. Each of the approaches indicated serve to subdue the aggressive individual by mechanically, electrically or chemically stunning the person and bringing them under control for a period of time sufficient to regain order.

In addition, devices which propel fluids seem to have existed for sometime. One form of such a fluid projection device is of the type shown in U.S. Pat. No. 3,197,070 granted on May 6, 1963 to C. F. Pearl, et al, for *Fluid Dispensing Device*, and in U.S. Pat. No. 4,591,071 granted on May 27, 1986 to Lonnie G. Johnson for Squirt Gun. Both of these devices seem to be useful as toys, but show no specific application other than simulating firing a weapon using water. Johnson shows an oscillator which is battery powered which produces space ray gun sounds. Neither, however, show any other application regarding use as a stun gun.

Another pistol type of fluid projection device wherein the fluid is propelled by compressed CO2 is shown in U.S. Pat. No. 1,634,976 granted on Jul. 5, 1927 to George W. Burke, Jr., for *Fire Extinquisher.* Burke, however, does not show any means for imparting an electrical charge to the discharged fluid. U.S. Pat. No. 2,249,608 granted on Jul. 15, 1941 to F. E. Greene for *Fluid Gas Gun,* shows a fluid discharged under pressure. This device, however, relies on the discharge of ammonia onto the individual to be controlled and it seems it would result in permanent skin damage; Greene does not show any means for electrical stunning.

Electrolytic cells used for timing and other purposes are shown in U.S. Pat. No. 3,423,643 granted on Jan. 21, 1969 to E. A. Miller for *Electrolytic Cell With Electrolyte Containing Silver Salt* and in U.S. Pat. No. 3,601,519 granted on Aug. 24, 1971 to Maurice P. Wanner for *Electrolytic ConductOr.* However, neither of the electrolytes are propelled out of their containers.

An electrical antipersonnel device is shown by George A. Wall in U.S. Pat. No. 3,374,708 granted on Mar. 26, 1968 for *Electrical Anti-Personnel WeapOn.* Wall does not show a method of alternating the voltage to obtain a high voltage nor does his invention showing mixing. Additionally, his device seems to be large and difficult to handle.

SUMMARY OF THE INVENTION

It is therefore an object of this invention to provide new and improved non-lethal weapons.

It is another object of this invention to provide new and improved stun guns.

It is yet another object of this invention to provide new and improved electrical stun guns.

It is still another object of this invention to provide new and improved electric stun guns which utilize an electrically conductive liquid.

It is yet still another object of this invention to provide new and improved electric stun guns which utilize electrically conductive liquid and electric circuitry capable of producing high voltage and low current.

It is still yet another object of this invention to provide new and improved electric stun guns which utlizie electrically conductive liquid wherein the liquid is mixed in each of twl self-contained chambers.

It is a further object of this invention to provide new and improved electric stun guns which utilize electrically conductive liquid wherein the high voltage is induced by alternating point contact closures and a coil or magnetos.

It is still a further object of this invention to provide new and improved electric stun guns which utilize electrically conductive fluid and wherein vane motion, mixing, activation and liquid discharge are achieved by use of pressurized gas.

It is yet a further object of this invention to provide new and improved electric stun guns wherein a three position trigger is utilized for arming and firing.

It is still a further object of this invention to provide new and improved electric stun guns which utilize magnetic, halls, or light pickups as triggering devices for electric or elec tronic high or low voltage systems used to supply fluid streams with electrical charges and which may be powered by either air or electrical means or both.

It is still yet a further object of this invention to provide new and improved electric stun guns in the form of pistols.

It is yet still a further object of this invention to provide new and improved electric stun guns which utilize two streams of liquid wherein one stream is high voltage and positively charged and the other stream is high voltage and negatively charged.

It is yet still a further object of this invention to provide new and improved electric stun guns in the form of rifles and incorporating backpacks wherein certain parts are stored for ease of carrying and for extending the operational time thereof.

This invention involves new and improved electric stun guns which utilize electrically conductive liquid mixed in storage containers, discharged by the excitation of compressed gas caused by the activation of a three position trigger, wherein two liquids combine external to the discharge point one stream being negatively charged and the other stream being positively charged with a high voltage induced by alternating point contact closures attached to a coil so as to effect a high voltage low current shock to the recipient of the stream of liquid.

Other objects, features and advantages of the invention in its details of construction and arrangement of parts will be seen from the above, from the following description of the preferred embodiment when considered with the drawings and from the appended claims.

BRIEF DESCRIPTION OF THE PREFERRED EMBODIMENT

Figure 1:
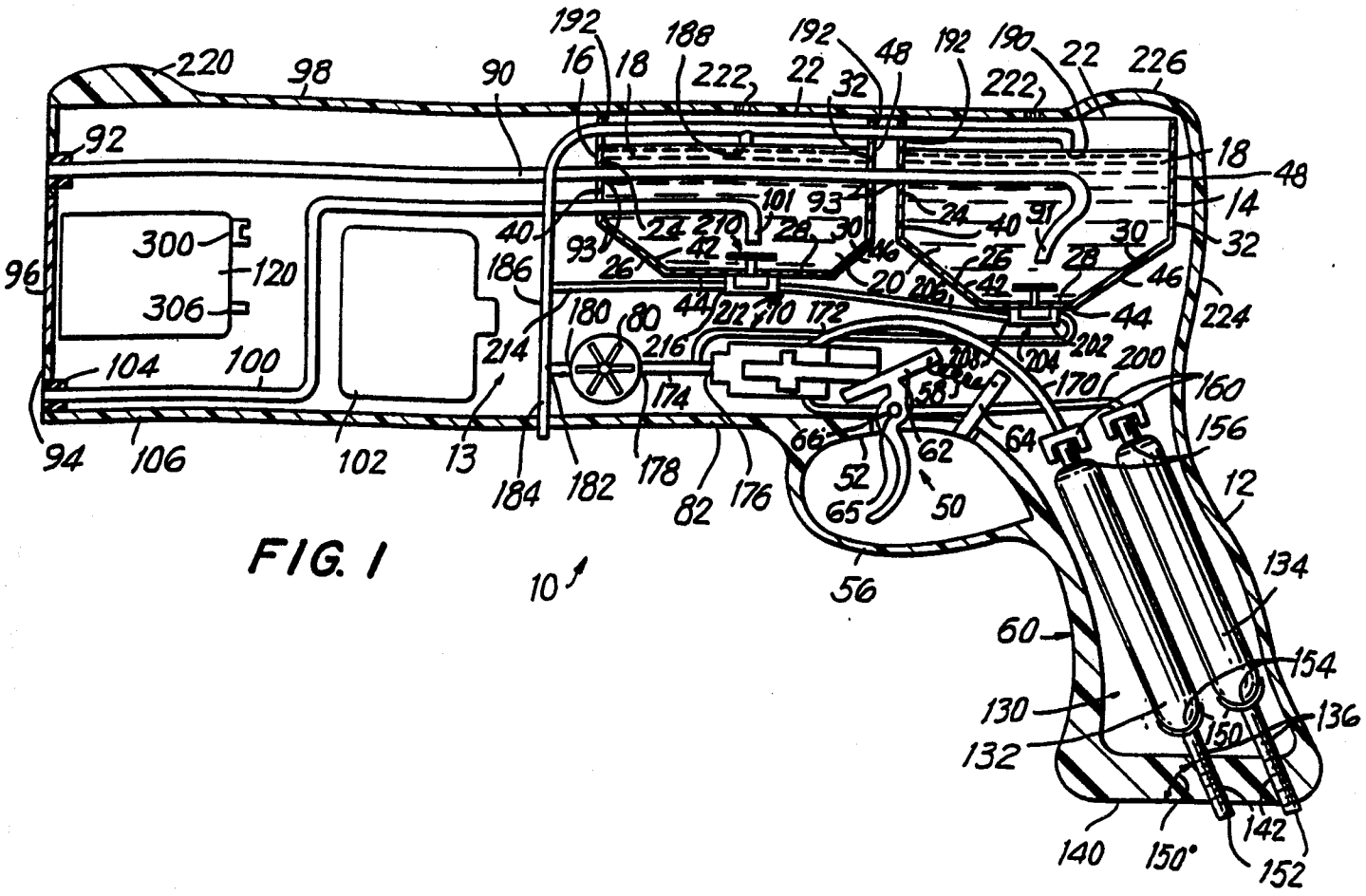
FIG. 1 is a side schematic cutaway view of the stun gun incorporating the instant invention showing its internal components and general configuration and in the form of a pistol.

With reference to FIG. 1, there is generally shown a stun gun 10. A casing 12 for stun gun 10 is essentially formed in the shape of a pistol and is made of a high impact plastic or the like and forms an interior cavity 13. Contained within cavity 13 of casing 12 by standard attachment means such as heat sealing, mechanical attachment or other appropriate means is a first liquid container 14 and a second liquid container 16, both of which are made of non-conductive materials. Each container 14, 16 is filled with a conductive liquid 18 to a predetermined level.

Conductive liquid 18 may consist of the following ingredients in the proportion given: 1 cup water; 2 teaspoons graphite; $2\frac{1}{2}$ teaspoons NaCl; $\frac{1}{4}$ teaspoon semi-powdered silver; or an equivalent conductive mixture, such as silver in an appropriate conductive form for use in the invention herein. Alternatively, conductive liquid 18 may consist of one or more resins, i.e.: cellulosic, synthetic, polymeric, natural gums and/or thickening agents, alkaloids, gelatins (either in a natural or a reacted state) or any other medium that would create the desired electrical charge in an aqueous median in a saline solution. Conductive solution 18 may be further enhanced by the inclusion of propylene glycol (a non-toxic, non-harmful freeze point depressant), or any other chemical which can safely lower the freeze point of the solution, thereby making its use practical and useable at below freezing temperatures.

An example of a parameter composition of the referenced solution 18 may thus be:

Water 0–99 parts
Resins 0.1–15 parts
Propylene Glycol 0–25 parts (or more)
Sodium Chloride 0.1–20 parts The foregoing volumetric ranges may be stated as weight proportions, approximately, as follows: water 66%, NaCl 7%, NATROSOL 250 HHR 0.6%, sodium nitrate 0.1%, propylene glycol 26%, and MITROL GST 0.3%. In terms of more generic designation, by weight proportions, as follows: water 66%; NaCl 7%; hydroxyethyl cellulose (as a thickening agent) 0.6%; sodium nitrate 0.1%; propylene glycol 26%; a preservative with the following ingredients: 1,3-chloroalkyl-3,5,7-triaza-1-azoniaadamantane chloride as a primary ingredient, and with sodium bicarbonate and hexamethylenetetramine hydrochloride 0.3%.

In addition to the above specific listing of components, solution 18 may be still further enhanced by the inclusion of appropriate inhibitors against corrosion and also a mildewcide to preserve the integrity of the solution while in storage.

Containers 14 and 16 each have a set of ends 20 (only one end 20 shown for each container 14, 16) spaced one from the other and of irregular shape having 6 sides; a top side 22, a front side 24, a front angle side 26, a bottom side 28, a back angle side 30, and a back side 32. Containers 14 and 16 each include: a front panel 40 of a predetermined length and which is deployed between and connects spaced ends 20 along front sides 24, a front angle panel 42 of a predetermined length and which is similarly deployed between and connects spaced ends 20 along front angle side 26; a bottom panel 44 of a predetermined length and which is likewise attached between ends 20 along bottom sides 28, a back angle panel 46 of similar predetermined length and which is deployed in a similar way between ends 20 along back angle sides 30; a back panel 48 of predetermined length similarly deployed along back side 32; and a top panel along with top side 22 and of a predetermined length equal to panels 40, 42, 44, 46 and 48; all so as to form liquid containers 14, 16.

A trigger mechanism 50 is enclosed by a bottom portion 52 of casing 12 and a trigger housing 56 proximate a handle 60. A gas release mechanism 70 coact with trigger mechanism 50. Air vain 80 and gas release mechanism 70 are deployed within cavity 13 of casing 12 proximate a center bottom portion 82 of casing 12. A trigger spring 58 is fixedly attached to a trigger bar 62 and a spring holder 64. A pivot pin 65 passes through a trigger pivot hole 66 arranged in a predetermined location through trigger 50 pin 65 is removably attached to casing 12 proximate portion 82 thereof.

A first liquid dispensing tube 90 has a first end 91 thereof disposed within the fluid contained within container 14 proximate the center and bottom 28 of container 14 and extends therefrom essentially parallel to top side 22 of containers 14 and 16 to terminate within a first flow nozzle 92 attached to a front surface 94 (FIGS. 1 and 2) of casing 12 at a predetermined position between a battery access door 96 essentially centrally disposed within front surface 94 and a top portion 98 of casing 12. Referring again to FIG. 1, a second liquid dispensing tube 100 has a first end 101 thereof disposed within the fluid contained within container 16 proximate the center and bottom 28 of container 16 and extends therefrom essentially parallel to top sides 22 of container 14 and 16 a predetermined length beyond a coil 102 at which point tube 100 is bent essentially 90 degrees and traverses a predetermined distance is again bent 90 degrees to be deployed in an orientation parallel to its initial orientation and extends longitudinally to terminate within a second flow nozzle 104 attached to front surface 94 at a predetermined position between door 96 and a front bottom portion 106 of casing 12. Nozzles 92 and 104 are essentially disposed midway between a set of sides 110 and 112 (FIG. 2) of casing 12. A set of holes 93, is disposed at predetermined positions through front panels 40 of containers 14, and 16 and back panel 48 of container 16 and through which buttress connectors (not shown) are affixed to accommodate the passage of tubes 90 and 100 through containers 14 and/or 16. Both tubes 90 and 100 are made of plastic or any other non-conductive material.

A battery 120 (FIG. 1) is disposed within cavity 13 of casing 12 proximate front 94 and door 96 thereof. Coil 102 is disposed essentially adjacent battery 120 within cavity 12 and rearward of battery 120 proximate front bottom section 106.

Contained within a handle cavity section 130 of cavity 13 are a first compressed gas cylinder 132 and a second compressed gas cylinder 134. Both gas cylinders 132 and 134 rest on a set of adjustable holders 136 threadably mounted through a bottom handle section 140 of casing 12. A set of threaded holes 142 are deployed through handle section 140 of casing 12 at an angle 150 which is essentially equal to the angle at which gas cylinders 132 and 134 are deployed within handle cavity 130. Each holder 142 is comprised of a cradle 150 and a threaded stem 152 fixedly attached to cradle 150.

Cylinders 132 and 134 each rest upon cradle 150 at a spherical end 154 and each contain at a valve end 156 disposed within a tap and pressure regulator 160. Each cradle 150 is essentially spherical in form and may be made of steel, plastic or other suitable material. Regulators 160 are of standard commercial configuration. A first gas tube 170 connects regulator 160 of cylinder 132 to release mechanism 70 at a first release mechanism inlet 172. A second gas tube 174 connects release mechanism 70 with air vane 80 at a first outlet 176 of release mechanism 70 with air vane 80 at a first out 176 of release mechanism 70 and an inlet 178 of air vane 80. An outlet 180 of air vane 80, deployed essentially diametrically opposite inlet 178, connects to a tee 182 which has a first pressurization port 188 deployed within container 16 and a second pressurization port 190 deployed within container 14. Each of the pressurization ports 188 and 190 are essentially centrally located proximate top sides 22 of their respective container 14, 16 and incorporate commercially available one-way valves. Feed tube 186 enters containers 14 and 16 and exits container 16 through a set of holes 192 by means of standard commercially available buttress fittings or the like.

Figure 6:
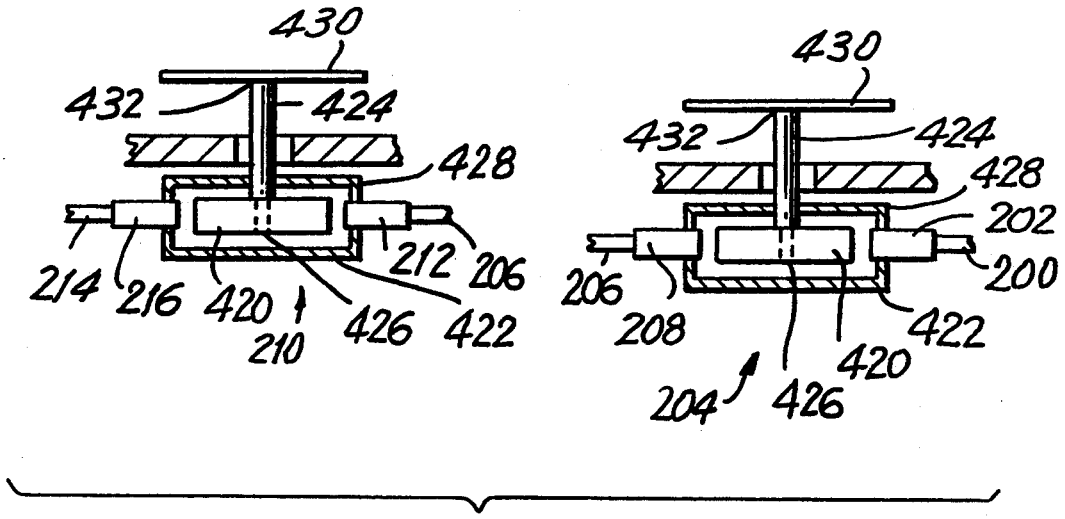
FIG. 6 is an enlarged schematic side cutaway view of the mixers of the stun gun of FIG. 1.

A second gas tube 200connects regulator 160 of cylinder 134 to release mechanism 70 with a first mixer inlet 202 of a first mixer 20 (FIG. 6) which is affixed to bottom panel 44 of container 14 (FIG. 1) proximate its center. A mixer connector gas tube 206 (FIGS. 1 and 6) traverses longitudinally from a first mixcer outlet 208 (FIG. 6) to a second mixer 210 through second mixer inlet 212. A mixer exhaust tube 214 exits mixer 210 through a second mixer outlet 216 and traverses essentially longitudinally a predetermined distance to connect with tube 186 (FIG. 1). Connections at junctions of tubes and mixers are accomplished with standard commercially available fittings.

Top portion 98 of casing 12 has a front site 200 (FIG. 1) integrally formed with or affixed to top 98 proximate its junction with front 94. At predetermined locations therealong a set of fill holes 222 are formed through top 98 proximate the center of containers 14 and 16. Proximate a rear section 224 of casing 12 integrally formed with or affixed to top 98 of casing 12 is a rear site 226. Front site 220 and rear site 226 extend above the plane formed by top portion 98 a predetermined amount.

Figure 3:
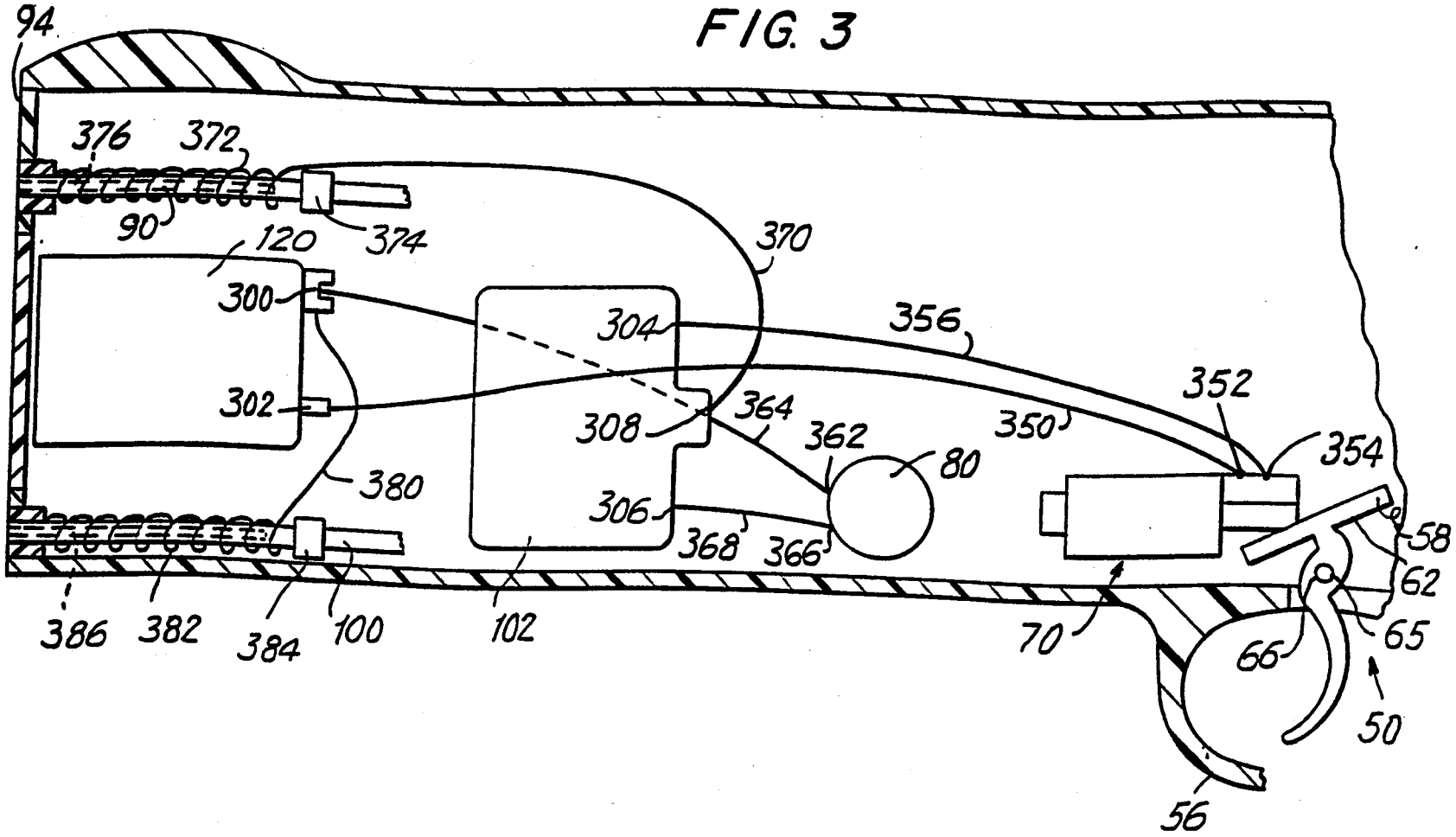
FIG. 3 is a side schematic cutaway view of the frontal position of the stun gun of FIG. 1 showing the electrical wiring.

Electrical wiring connections are shown in FIG. 3. Battery 120 has a negative battery terminal 300 and a positive battery terminal 302 and is a standard commercially available battery. Coil 102 is also a commercially available item with a positive coil terminal 304, a negative coil terminal 306, and a high voltage output terminate at 308.

Figure 4:
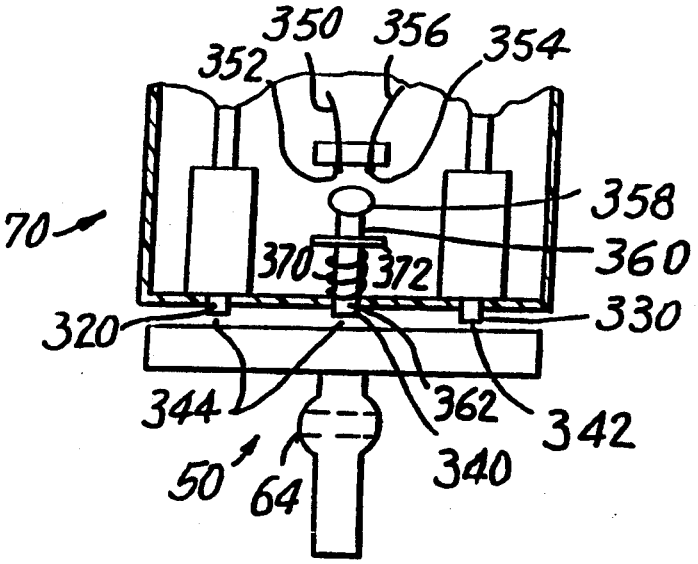
FIG. 4 is a rear schematic view of the trigger trip mechanism of the stun gun of FIG. 1.

Trigger mechanism 50, as shown in FIG. 4, delineates a main gas release mechanism 320, a mixer gas release mechanism 330 and an electric switch bar 340 also deployed to coact with trigger bar 62. A first gap 342 between mixer release mechanism 330 and bar 62 is of a predetermined size so as to coact with bar 62 at an intermediate pull of trigger 50. A second gap 344 between main release mechanism 320 and electric switch bar 340 is a predetermined size larger than gap 342 and coact with bar 62 after a second pull of trigger 50.

A first switch wire 350 connects positive battery terminal 302 to first switch bar terminal 352 (FIGS. 3 and 4). A second switch bar terminal 354 is attached to a second switch wire 356 which is attached to positive coil terminal 304. Terminals 352 and 354 are connected by a terminal connector 358 disposed proximate a top end 360 of switch bar 340 opposite a bottom end 362 proximate trigger bar 62. A switch bar spring 370 is deployed over switch bar 340 and contained in position by a spring plate 372.

Figure 5:
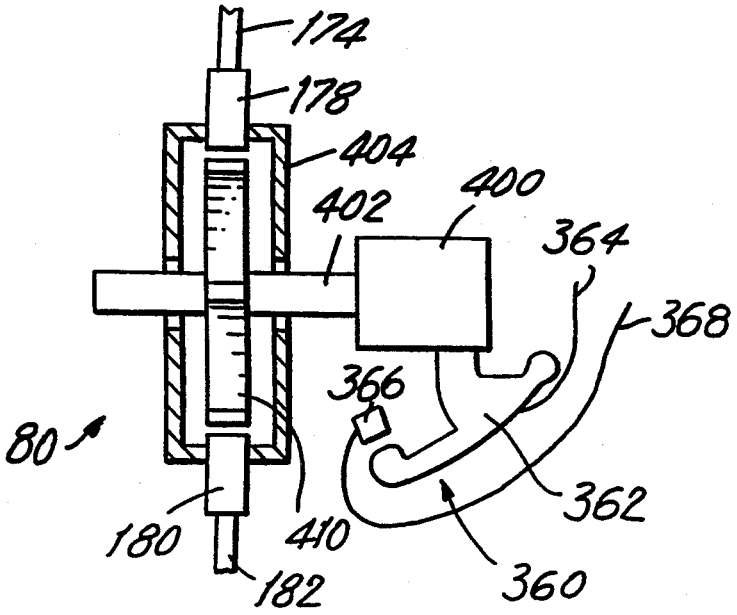
FIG. 5 is an enlarged side view of the point contact mechanism for generating the high voltage current used by the stun gun of FIG. 1.

Air vane 80 (FIGS. 1, 3 and 5) coact with a set of points 360. A moveable point contact 362 has a moveable point wire 364 attached thereto which is connected to negative battery terminal 300. A fixed point contact 366 has a fixed point wire 368 attached thereto which is connected to negative coil contact 306. A high voltage fluid wire 370 is deployed as a first coil 372 wrapped around tube 90 proximate front 94 and connected thereto by a connector and is further attached to a conductive tube 376 deployed within tube 90 and which is fixedly attached to tube 90 (FIG. 3). Similarly, a negative fluid battery wire 380 is formed as a second coil 382 wrapped around tube 100 proximate front 94 and is connected thereto with a connector 384 and is further attached to a conductive tube 376 deployed within tube 100 and which is fixedly attached to tube 100.

Figure 2:
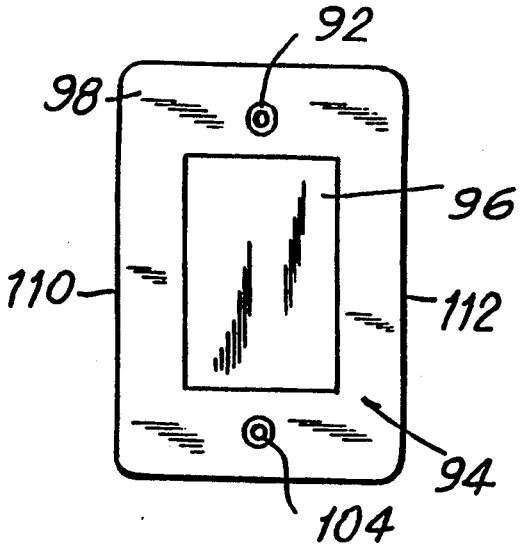
FIG. 2 is a schematic frontal view of the barrel of the stun gun of FIG. 1.

In FIG. 2, moveable point 362 coact with a four lobe cam 400 fixedly attached to a cam shaft 402 mounted through a housing 404 of air vane 80 and fixedly attached to an air vane impeller 410 which is deployed within housing 404.

Mixers 204 and 206 (FIG. 6) each have a mixer impeller 420 diposed within a housing 422. A mixer shaft 424 is fixedly attached on each impeller 420 proximate a first end 426 and is mounted through a top surface 428 of housing 422 and bottom panel 44 of containers 14 and 16. A mixer blade 430 is attached proximate a second end 432 of mixer shaft 424.

Operation

Gas from gas cylinder 130 passes through regulator 160 into gas release mechanism 70 and is released to flow into and pressurize liquid 18 in containers 14 and 16 is activated. The first activation of trigger 50 so releases gas to pressurize containers 14, 16 through tubes 90 and 100. Trigger 50 is then fully activated to rotate cam 400 which opens and closes contact between stationary point 366 and moveable point 362. Trigger 50 also soacts with switch bar 340 which activates a high voltage current that is transmitted to high voltage fluid coil 372 and is generated by coil 102 and points 360. The pressurized liquid 18 in container 14, 16 will flow toward front 94 of gun 10 and exit nozzles 92 and 104 respectively. Pressure is regulated through vent tube 184. Liquid exiting tube 90 will carry high voltage current while liquid exiting tube 100 will be at ground potential, thus making a closed circuit when combined at the target imparting a stun or electric shock thereto. Additioinally, when trigger 50 is pulled to an intermediate position mixers 204 and 210 will be activated prior to the release of liquid 18 preparing liquid 18 for use. Alternately, the mixing of liquid 18 may be achieved with a separate switch.

Figure 7:
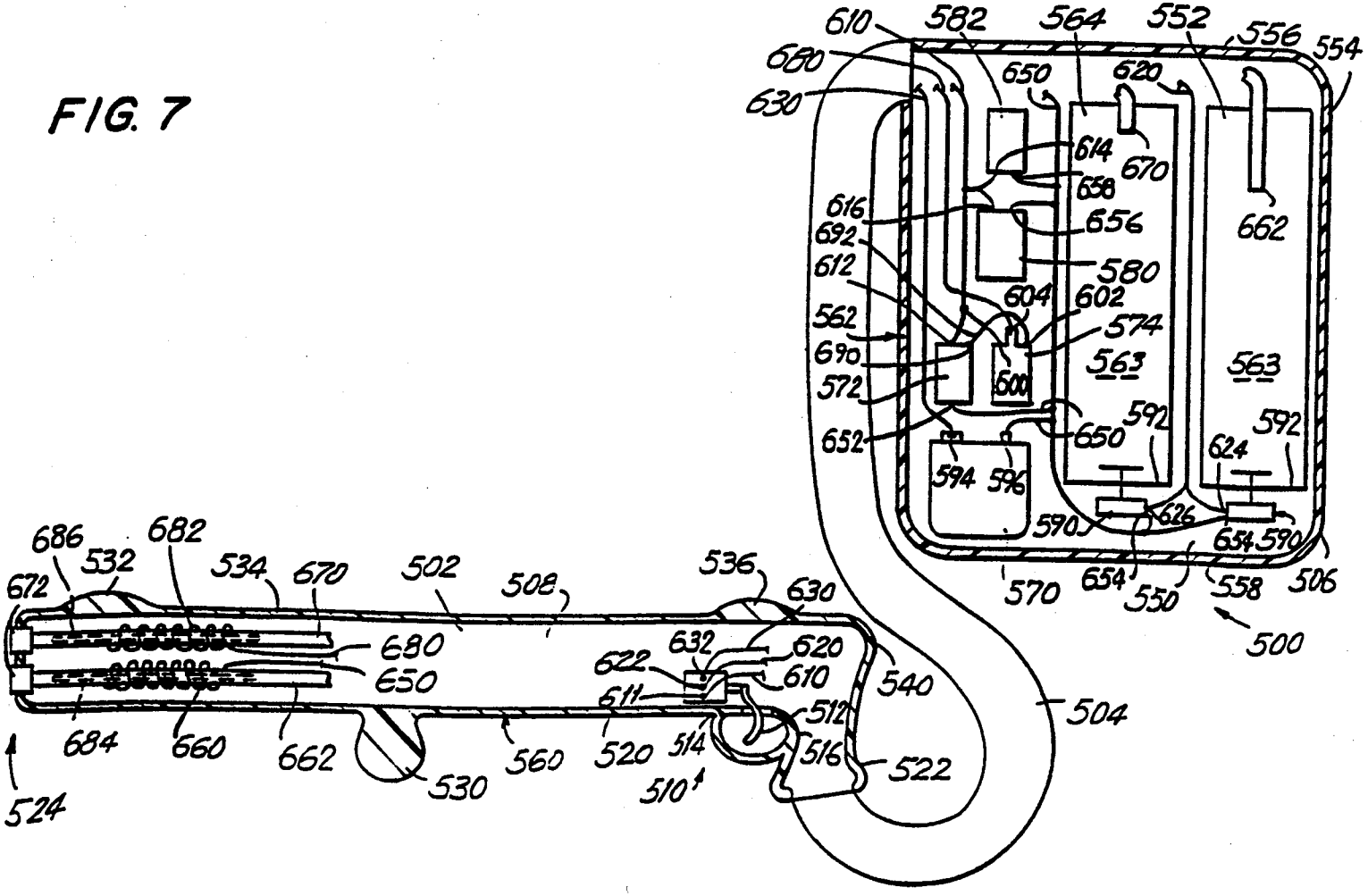
FIG. 7 is a side schematic cutaway view of an alternative embodiment of stun gun incorporating the instant invention showing its internal components and with the general configuration in the form of a rifle and backpack with components therein.

With reference to FIG. 7, there is generally shown a rifle stun gun system 500 incorporating a rifle section 502 connected by a flexible cable 504 to a backpack 506. Contained within a cavity 508 of rifle section 502 is a trigger switch 510 proximate a trigger 512 located proximate a junction 514 formed where a rifle bottom 520 and a rifle handl 522 join. Essentially midway between junction 514 and a front end 524 a grip 530 is deployed which projects essentially perpendicular from rifle bottom 520. Rifle section 502 is essentially cylindrical in shape with a front site 532 proximate front 524 integrally formed or affixed to a top 534. A rear site 536 is located proximate a rear section 540 integrally formed or affixed to top 534.

Backpack 506 is essentially a rectangular box forming a cavity 550 within which is mounted a first rifle liquid container 552 proximate a first backpack side 554 essentially central to a backpack top 556 and backpack bottom 558 and a pair of backpack ends 560 (not shown) which connect top 556, bottom 558 first side 554 and a second backpack side 562. A second rifle liquid container 564 is mounted adjacent to container 552 a predetermined distance therefrom and extending toward side 562. A conductive liquid 563 such as or similar to that utilized in the embodiments of FIGS. 1–6 is disposed in containers 552 and 564. Proximate bottom 558 and side 562 between ends 560 is a battery 570. A point pack 572 is deployed above battery 570 proximate side 562 and a coil 574 is deployed between container 564 and point pack 572 above battery 570 and between ends 560. A first electric pump 580 is disposed between ends 560 and between side 562 and container 564, above pack 572 and coil 574 and below a second electric pump 582. Pump 582 is similarly deployed between ends 560, and side 562 and container 564 above pump 580 proximate top 556.

Rifle section 502 and backpack 506 have respectively a rifle casing 560 and a backpack casing 562 made of plastic or other like non-conductive material. Containers 554 and 564 each have a mixer motor 590 deployed through a bottom panel 592 essentially in the center thereof and proximate backpack bottom 558. Battery 570 has a positive battery terminal 594 and a negative battery terminal 596 deployed on a top surface thereof; coil 574 has a positive coil terminal 600, a negative coil terminal 602 and a high voltage terminal 604.

A first trigger wire 610 is attached to a first trigger terminal 612 and connects with point pack 572 after passing through cable 504 at a stationary contact 612 and to positive coil terminal 600. Wire 610 is also connected to a positive pump contact 614 of pump 582 and a positive pump contact 616 of pump 580. A second trigger wire 620 attached to a second trigger terminal 622 passes through cable 504 and terminates at first mixer terminal 624 and a second mixer terminal 626. A third trigger wire 630 attached to a third trigger terminal 632 passes through cable 504 and terminates at positive battery terminal 594.

A number of connections are made between a negative battery wire 650 from negative battery terminal 594 and the following: a condenser terminal 652 deployed in point pack 572, a pair of negative mixer motor terminals 654 deployed on each of the two mixers 570, a first negative pump terminal 656 of pump 580, a second negative pump terminal 658 of pump 582 and a negative coil 660 fixedly attached to a first fluid line 662 deployed in cavity 508 of rifle section 502.

Fluid line 662 and the portion of wire 650 attached thereto pass through cable 504. Line 662 is also deployed within container 552. A second fluid line 670 deployed within container 564 passes through cable 504 into rifle section 502. Both lines 662 and 670 terminate at a set of nozzles 672 mounted in front 524 of rifle section 502. A high voltage wire 680 is fixedly attached to a high voltage coil 682 which is fixedly attached to line 670. A first conductive rod 684 is encapsulated within line 662 proximate nozzle 672, a second conductive rod 686 is similarly encapsulated within line 670. Wire 680 passes through cable 504 and attaches to high voltage terminal 604 of coil 574. A moveable contact 690 of point pack 572 is attached by a jumper wire 692 to negative coil terminal 602.

Actuation of trigger 512 establishes electrical contacts to energize and operate pumps 580 and 582 to propel fluid 683 through fluid lines 662 and 670. Actuation of trigger 512 also establishes an electric charge of fluid 683 as it projects from rifle stun gun system 500. The charged liquid upon impinging upon a target will create a shock that stuns as described for the embodiment of FIGS. 1–6.

Figure 8:
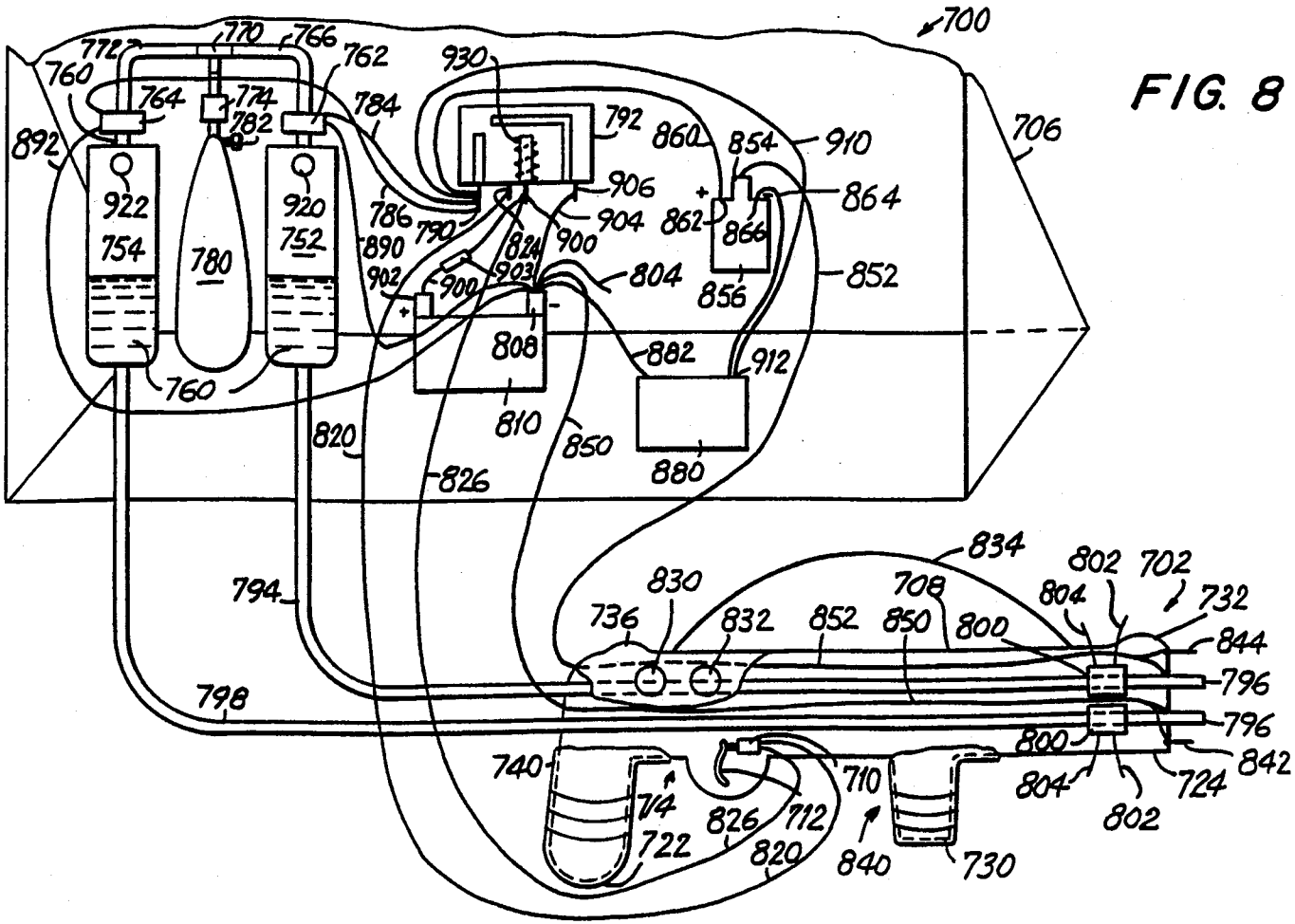
FIG. 8 is a side schematic cutaway view of another alternative embodiment of stun gun incorporating the instant invention showing its internal components and with the general configuration in the form of a rifle and backpack with components therein.

With reference to FIG. 8, there is generally shown an alternative embodiment of a rifle stun gun system 700 incorporating a rifle section 702 connected to a backpack 706 by a flexible cable (not shown), but similar to flexible cable 504 of FIG. 7. For convenience and ease of understanding, the invention, the elements and components which extend through the flexible cable are shown.

Contained within a cavity 708 of rifle section 702 is a trigger switch 710 disposed proximate and for coaction with a trigger 712 located proximate a junction 714 formed where a rifle bottom 720 and a rifle handle 722 join. Essentially midway between junction 714 and a front end 724 of rifle section 702 a grip 730 is deployed which projects essentially perpendicular from rifle bottom 720. Rifle section 702 is essentially cylindrical in shape with a front site 732 proximate front 724 integrally formed or affixed to a top 734. A rear site 736 is located proximate a rear section 740 integrally formed or affixed to fop 734.

Backpack 706, like backpack 504 of FIG. 7, is essentially box-like in configuration andincludes a cavity 750 within which is mounted a first rifle liquid container 752 and a second rifle liquid container 754, both of which are formed of non-conductive material such as plastic or the like. Conductive liquid or fluid 760, such as or similar to, fluid 18 utilized in the embodiments of FIGS. 1–7 are disposed in containers 752 and 754. Containers 752, 754 are constructed so as to be capable of withstanding 100 psi or better and are each formed at their upper ends with necked down portions 760 which, in turn, receive valves 762, 764. A tube 766 connects valve 762 to one side of a "T" fitting 770 another side of which is connected by a tube 772 to valve 764. The leg of "T" fitting 770 connects to a regulator or regulating valve 774 that closes off and regulates the flow of gas from a compressed air or gas cylinder 780. A suitable and appropriate supply of compressed air or gas, such as CO2, nitrogen or the like, is disposed in cylinder 780 under pressure between 1,000 psi to 2000 psi. A fill valve 782 is carried by cylinder 780 for use in replenishing the supply of gas or air therein. The quantity of air or gas in cylinder 780 is such as to be sufficient to empty liquid 760 from both containers 752 and 754. Regulator or regulator valve 774 is selected to adjust cylinder 780 pressure to a desired working pressure for liquid 760 preferably to about 40 psi. "T" fitting 770 is of conventional construction and selected to split the gas or air exiting cylinder 780 into two separate streams, one for fluid container 752, the other for container 754. Valves 760, 762 are also of conventional construction and may be either one-way type valves or electrically operated shut-off valves electrically connected by conductive wire 784, 786 to a terminal 790 of a relay 792 also disposed in backpack 706. Relay 792 is of conventional construction and is electrically connected to the other components as herein described.

A tube 794 extends from a suitable opening provided at the bottom of cylinder 752 to a nozzle 796 at the front end of rifle section 702. A tube 798 extends from a suitable opening provided at the bottom of cylinder 754 to a similar nozzle 796 also provided at the front end of rifle section 702. Tubes 794 and 798 are of non-conductive material and of a length and diameter commensurate with the desired fluid flow and disposition of backpack 706 and rifle section 702. A pressure operated valve 800 is disposed in-line for each tube 794,798 proximate the ends thereof connected to nozzles 796 to facilitate operation of stun gun 700. Valves 800 are of conventional construction and preferably set to operate and release conductive fluid 760 at approximately 5–40 psi. Appropriate electrically conductive but insulated wiring 802 connects positive terminals of valves 800 to terminal 790 of relay 792; while similar conductive wire 804 connects the negative terminals of valves 800 to the negative terminal 808 of a 12 volt power supply preferably in the form of a battery 810 also disposed in backpack section 706.

An electrically conductive wire 820 extends from one contact of switch 710 to electrically connect same to a terminal 824 of relay 792; while an electrically conductive wire 826 extends from the other contact of switch 710 to a terminal 828 of relay 792. Thus, upon actuation of trigger 712 the contacts of switch 710 are closed and circuit completed through terminals 790 and 824 of relay 792.

A pressure gauge 830, of conventional construction and conventionally connected to gas/air cylinder 780, is carried by rifle section 702 to provide an indication of the pressure in cylinder 780. A fluid level gauge 832, of conventional construction and conventionally connected to fluid containers 752, 754, is also carried by rifle section 702 to provide an indication of the level of fluid 760 in containers 752,754.

A shoulder sling 834 of suitable material is connected to rifle section 702 to enable the weight of this handheld unit to be placed on a user's shoulders when not in use and otherwise disposed to minimize or prevent fatigue when stun gun 700 is in use. The components of rifle section 702 are enclosed in a case 840 of rifle-like configuration and which is formed from non-conductive material such as nylon, plastic or the like which is of sufficient strength to enable rifle section 702 to be used as a club, if necessary. A pair of points 842, 844 extend forward from a front face of rifle section 702. An electrically conductive wire 850 electrically connects point 842 to terminal 808 of battery 810 and at the same time also connects fluid tube 796 into the electrical circuit of battery 810. An electrically conductive wire 852, electrically connects point 842 to a high output tower 854 of a coil 856 also disposed in backpack section 706. Wire 852 also connects fluid tube 794 into the electrical circuit of battery 810 and has an insulating cover to prevent high voltage from leaking through to any other components other than what it is to connect to.

Coil 856 is of conventional construction and constitutes a high voltage source and may, for example, be an ignition coil of the type used in automobiles, capable of putting out 60,000 volts and used in conjunction with an electronic triggering device. An electrically conductive wire 860 extends from a positive terminal 862 of coil 856 to terminal 790 of relay 792. An electrically conductive wire 864 extends from a negative terminal 866 of coil 856 to a triggering device 880. Device 880 is of conventional construction and may be, for example, a magnetic or halls pickup device as utilized in automotive applications and equipped with a reluctor or triggering wheel turned by a small electric motor (not shown) or air pressure which sends pulses to a control unit (not shown) that, in turn, acts as a switching device for coil 856. An electrically conductive wire 882 extends from triggering device 880 to negative post 808 of battery 810.

Further electrically conductive wires 890, 892 extend from negative post 808 of battery 810 to negative connections provided for valves 762,764 respectively. An electrically conductive wire 900 extends from a positive terminal 902 of battery 810 to terminal 828 of relay 792 and includes an in-line fuse of 903 conventional construction and electrical characteristics commensurate with the described electrical circuitry. A further electrically conductive wire 904 electrically connects negative terminal 808 of battery 810 to a terminal 906 of relay 792. Still another electrically conductive wire 910 electrically connects terminal 790 of relay 792 to a positive connection 912 of triggering device 880.

It should be noted that fill plugs 920, 922 are provided for fluid containers 752 and 754, respectively, to facilitate filling same with conductive fluid 760.

The electric circuitry, component selection, disposition and mounting are such that the high voltage produced in the respective components is prevented from grounding both internally and externally. Thus, fluid containers 752, 754 are insulated from each other and from other components in conventional ways and by conventional means. Fluid tubes 794,796 are likewise constructed from non-conductive material, insulated from each other and from other components; except those connected to them to act upon the fluid 760 as it passes therethrough and has electrical charge imparted to it. The high voltage source 856 and wires carrying high voltage are also especially well insulated to prevent leakage to other components. If necessary, diodes may be utilized to keep electrical current flowing in only one direction. Valves 762, 764 and 800, if electrically operated, have their respective electrical components insulated from parts that come in contact with or may come in contact with fluid 760. The body of backpack 706 and rifle section 702 also are to be made from non-conductive materials to insulate components from each other and from the person using stun gun 700.

Actuation on trigger 712 closes the contacts of switch 710 and activates a magnetic coil 930 within relay 792 connecting terminals 828 and 790 of relay 792. Valve 774 is operated to release air/gas pressure from cylinder 780 through tubes 766 and 772 respectively and upon actuation of valves 762, 764 to apply pressure to fluid 760 within fluid cylinders 752,754. Fluid 760, now under pressure flows through tubes 794, 798 and with valves 800 operated through nozzles 796 in respective streams. The high voltage from battery 810 through triggering device 880 and coil 856 is applied to the fluid streams and upon impinging upon a person and completing an electrical path thereon acts to stun the person. If fluid 760 is used up application of points 842, 844 against a person will also apply the generated high voltage to them to stun them.

Figure 9:
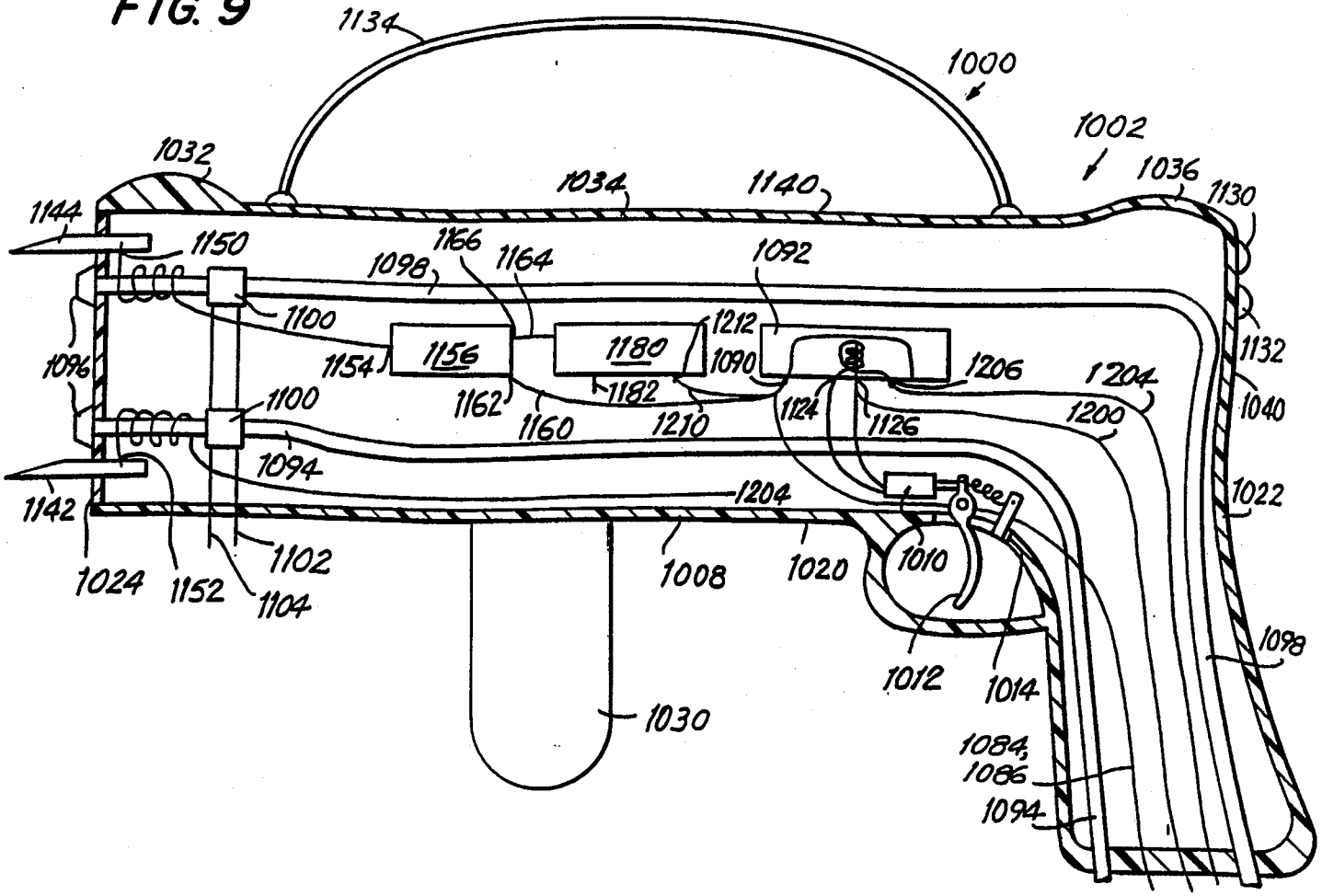
FIG. 9 is a side schematic cutaway view of still another alternate embodiment of the rifle portion of a stun gun showing its internal components and which is intended for use with the backpack of FIG. 10.
Figure 10:
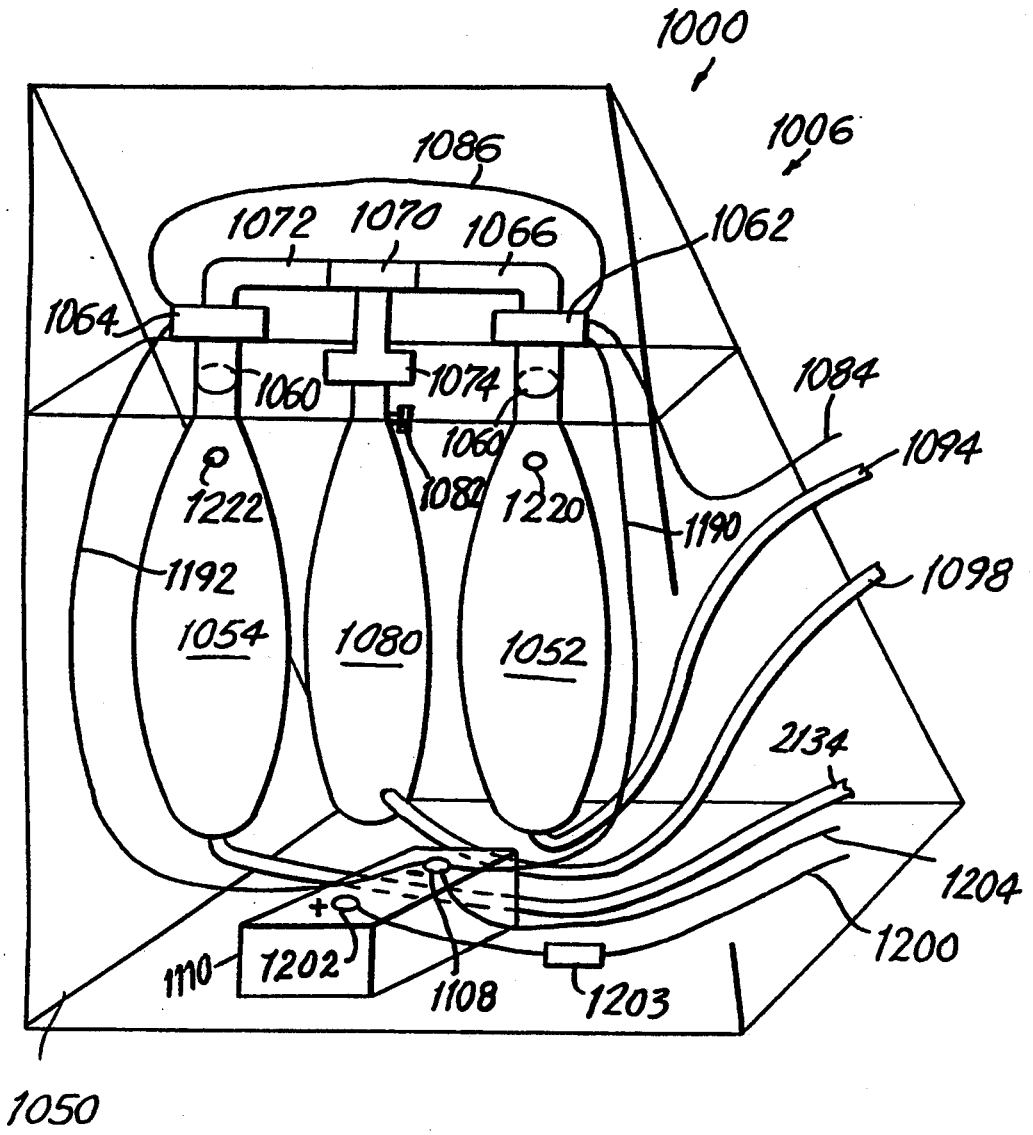
FIG. 10 is a schematic showing of a backpack for use with the stun gun of FIG. 9 and/or with the stun gun of FIG. 12 and further showing the components carried within the backpack.

With reference to FIGS. 9 and 10, there is generally shown an alternative embodiment of a rifle stun gun system 1000 incorporating a rifle section 1002 connected to a backpack 1006 by a flexible cable (not shown), but similar to flexible cable 504 of FIG. 7. For convenience and ease of understanding, the invention and components which extend through the flexible cable are shown.

Contained within a cavity 1008 of rifle section 1002 is a trigger switch 1010 disposed proximate and for coaction with a trigger 1012 located proximate a junction 1014 formed where a rifle bottom 1020 and rifle handle 1022 join. Essentially midway between junction 1014 and a front end 1024 of rifle section 1002 a grip 1030 is deployed which projects essentially perpendicular from rifle bottom 1020. Rifle section 1002 is essentially cylindrical in shape with a front site 1032 proximate front 1024 integrally formed or affixed to a top 1034. A rear site 1036 is located proximate a rear section 1040 integrally formed or affixed to top 1034.

Backpack 1006, like backpack 504 of FIG. 7, and 702 of FIG. 8 is essentially box-like in configuration and includes a cavity 1050 within which is mounted a first rifle liquid container 1052 and a second rifle liquid container 1054, both of which are formed of non-conductive material such as plastic or the like. Conductive liquid or fluid 1060, such as or similar to, fluid 18 utilized in the embodiments of FIGS. 1–8 are disposed in containers 1052 and 1054. Containers 1052, 1054 are constructed so as to be capable of withstanding 100 psi or better, and are each formed at their upper ends with necked down portions 1060 which, in turn, receive valves 1062, 1064. A tube 1066 connects valve 1062 to one side of a "T" fitting 1070, another side of which is connected by a tube 1072 to valve 1064. The leg of "T" fitting 1070 connects to a regulator or regulating valve 1074 that closes off and regulates the flow of gas from a compressed air or gas cylinder 1080. A suitable and appropriate supply of compressed air or gas, such as CO2, nitrogen or the like, is disposed in cylinder 1080 under pressure between 1,000 psi to 2,000 psi. A fill valve 1082 is carried by cylinder 1080 for use in replenishing the supply of gas or air therein. The quantity of air or gas in cylinder 1080 is such as to be sufficient to empty liquid 1060 from both containers 1052 and 1054. Regulator or regulator valve 1074 is selected to adjust cylinder 1080 pressure to a desired working pressure for liquid 1060 preferably to about 40 psi. "T" fitting 1070 is of conventional construction and selected to split the gas or air exiting cylinder 1080 into two separate streams, one for! fluid container 1052, the other for container 1054. Valves 1060, 1062 are also of conventional construction and may be either one-way type valves or electrically operated shut-off valves electrically connected by conductive wires 1084, 1086 to a terminal 1090 of a relay 1092 also disposed in rifle section 1002. Relay 1092 is of conventional construction and is electrically connected to the other components as herein described.

A tube 1094 extends from a suitable opening provided at the bottom of cylinder 1052 to a nozzle 1096 at the front end of rifle section 1002. A tube 1098 extends from a suitable opening provided at the bottom of cylinder 1054 to a similar nozzle 1096 also provided at the front end of rifle section 1002. Tubes 1094 and 1098 are of non-conductive material and of a length and diameter commensurate with the desired fluid flow and disposition of backpack 1006 and rifle section 1002. A pressure operated valve 1100 is disposed in-line for each tube 1094, 1098 proximate the ends thereof connected to nozzles 1096 to facilitate operation of stun gun 1000. Valves 1100 are of conventional construction and preferably set to operate and release conductive fluid 1060 at approximately 5–40 psi. Appropriate electrically conductive but insulated wiring 1102 connects positive terminals of valves 1100 to terminal 1090 of relay 1092; while similar conductive wire 1104 connects the negative terminals of valves 1100 to the negative terminal 1108 of a 12 volt power supply preferably in the form of a battery 1110 also disposed in backpack section 1006.

An electrically conductive wire 1120 extends from one contact of switch 1010 to electrically connect same to a terminal 1124 of relay 1092; while an electrically conductive wire 1126 extends from the other contact of switch 1010 to a terminal 1128 of relay 1092. Thus, upon actuation of trigger 1012, the contacts of switch 1010 are closed and circuit completed through terminals 1090 and 1124 of relay 1092.

A pressure gauge 1130, of conventional construction and conventionally connected to gas/air cylinder 1080, is carried by rifle section 1002 to provide an indication of the pressure in cylinder 1080. A fluid level gauge 1132, of conventional construction and conventionally connected to fluid containers 1052, 1054, is also carried by rifle section 1002 to provide an indication of the level of fluid 1060 in containers 1052, 1054.

A shoulder sling 1134 of suitable material is connected to rifle section 1002 to enable the weight of this hand held unit to be placed on a user's shoulders when not in use and otherwise disposed to minimize or prevent fatigue when stun gun 1000 is in use. The components of rifle section 1002 are enclosed in a case 1140 of rifle-like configuration and which is formed from non-conductive material such as nylon, plastic or the like which is of sufficient strength to enable rifle section 1002 to be used as a club if necessary. A pair of points 1142, 1144 extend forward from front face of rifle section 1002. An electrically conductive wire 1152 electrically connects point 1142 to terminal 1108 of battery 1110 (FIG. 10) and at the same time also connects fluid tube 1094 into the electrical circuit of battery 1110. An electrically conductive wire 1150, electrically connects points 1144 to a high output tower 1154 of a coil 1156 also disposed in rifle section 1002. Wire 1154 also connects fluid tube 1098 into the electrical circuit of battery 1110 andhas an insulating cover to prevent high voltage from leaking through to any other components other than what it is to connect to.

Coil 1156 is of conventional construction and constitutes a high voltage source and may, for example, be an ignition coil of the type used in automobiles, capable of putting out 60,000 volts and used in conjunction with an electronic triggering device. An electrically conductive wire 1160 extends from a positive terminal 1162 of coil 1156 to terminal 1090 of relay 1092. An electrically conductive wire 1164 extends from a negative terminal 1166 of coil 1156 to a triggering device1180. Device 1180 is of conventional construction and may be, for example, a magnetic or halls pickup device as utilized in automotive applications and equipped with a reluctor or triggering wheel turned by a small electric motor (not shown) or air pressure which sends pulses to a control unit (not shown) that, in turn, acts as a switching device for coil 1156. An electrically conductive wire 1182 extends from triggering device 1180 to negative post 1108 of battery 1110.

Further electrically conductive wires 1190, 1192 extend from negative post 1108 of battery 1110 to negative connections provided for valves 1062, 1064 respectively. An electrically conductive wire 1200 extends from a positive terminal 1202 of battery 1110 to terminal 1128 of relay 1092 and includes an in-line fuse of 1203 conventional construction and electrical characteristics commensurate with the described electrical circuitry. A further electrically conductive wire 1204 electrically connects negative terminal 1108 of battery 1110 to a terminal 1206 or relay 1092. Still another electrically conductive wire 1210 electrically connects terminal 1090 of relay 1092 to a positive connection 1212 of triggering device 1180.

It should be noted that fill plugs 1220, 1222 are provided for fluid containers 1052 and 1054 respectively to facilitate filling same with conductive fluid 1060.

The electrical circuitry, component selection, disposition and mounting are such that the high voltage produced in the respective components is prevented from grounding both internally and externally. Thus, fluid containers 1052, 1054 are insulated from each other and from other components in conventional ways and by conventional means. Fluid tubes 1094, 1096 are likewise consdtructed from non-conductive material, insulated from each other and from other components; except those connected to them to act upon the fluid 1060 as it passes therethrough and has electrical charge imparted to it. The high voltage source 1156 and wires carrying high voltage are also especially well insulated to prevent leakage to other components. If necessary, diodes may be utilized to keep electrical current flowing in only one direction. Valves 1062, 1064 and 1100, if electrically operated, have their respective electrical components insulated from parts that come in contact with or may come in contact with fluid 1060. The body of backpack 1006 and rifel section 1002 also are to be made from non-conductive materials to insulate components from each other and from the person using stun gun 1000.

Actuation of trigger 1012 closes the contacts of switch 1010 and activates a magnetic coil 1230 within relay 1092 connecting terminals 1128 and 1090 of relay 1092. Valve 1074 is operated to release air/gas pressure from cylinder 1080 through tubes 1066 and 1072 respectively and upon actuation of valves 1062, 1064 to apply pressure to fluid 1060 within fluid cylinders 1052, 1054. Fluid 1060, now under pressure flows through tubes 1094, 1098 and with valves 1100 operated through nozzles 1096 in respective streams. The high voltage from battery 1110 through triggering device 1180 and coil 1156 is applied to the fluid streams and upon impinging upon a person and completing an electrical path thereon acts to stun the person. If fluid 1060 is used up, application of points 1142, 1144 against a person will also apply the generated high voltage to them to stun them.

Figure 11:
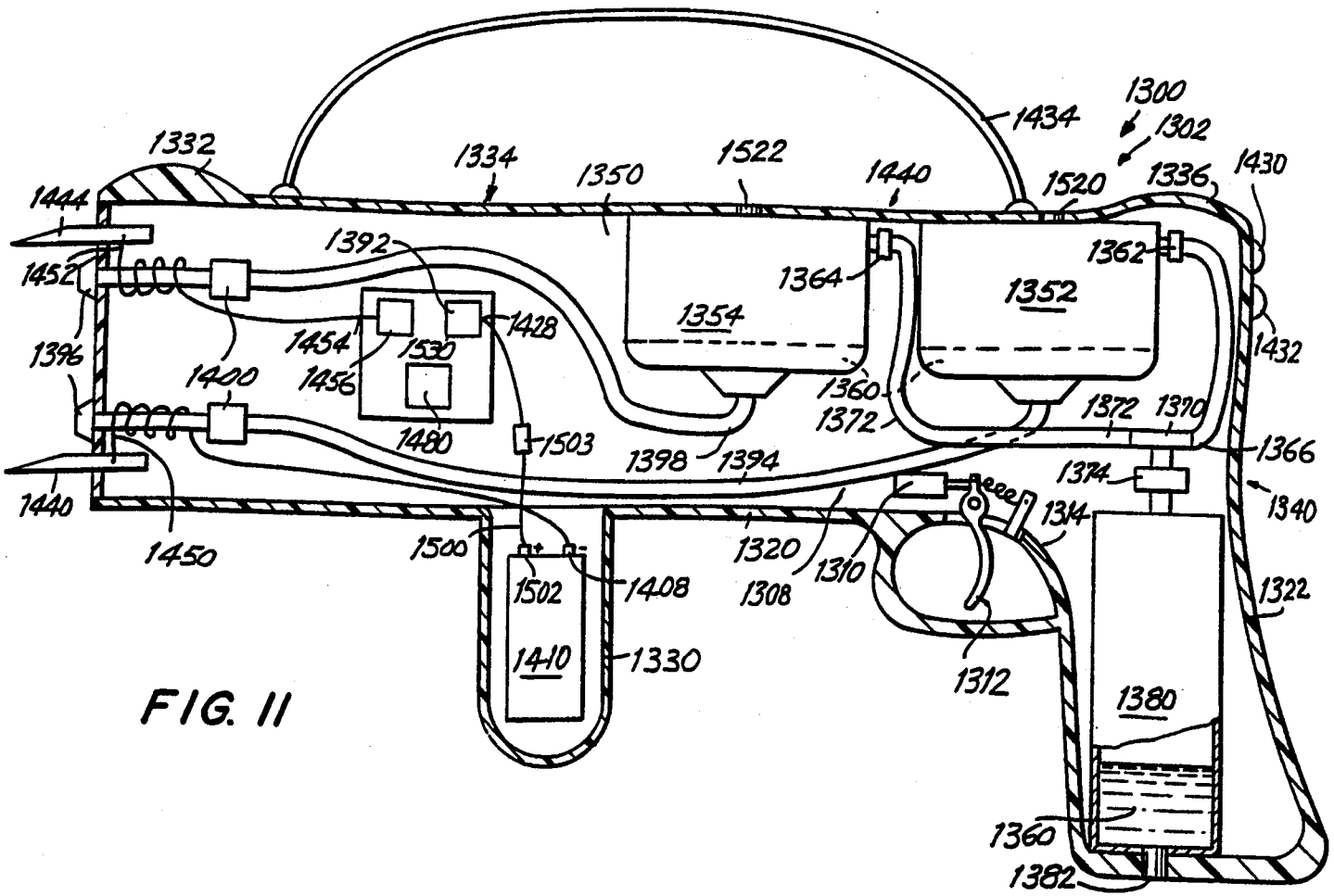
FIG. 11 is a side schematic cutaway view of still another alternative embodiment of stun gun incorporating the instan invention showing its internal components and general configuration and in the form of a self-contained hand-held unit.

With reference to FIG. 11, there is generally shown an alternative embodiment of stun gun system 1300 in the form of a self-contained hand-held unit 1302.

Contained within a cavity 1308 of gun unit 1302 is a trigger switch 1310 disposed proximate and for coaction with a trigger switch 1312 located proximate a junction 1314 formed where a bottom 1320 and a handle 1322 join. Essentially midway between junction 1314 and a front end 1324 of unit 1302 a grip 1330 is deployed which projects essentially perpendicular from bottom 1320. Unit 1302 is essentially cylindrical in shape with a front site 1332 proximate front 1324 integrally formed or affixed to a top 1334. A rear site 1336 is located proximate a rear section 1340 integrally formed or affixed to top 1334.

Unit 1302 is essentially hollow and includes a cavity 1350 within which is mounted a first liquid container 1352 and a second liquid container 1354, both of which are formed of non-conductive material such as plastic or the like. Conductive liquid or fluid 1360 such as or similar to fluid 18 utlized in the embodiments of FIGS. 1–10 are disposed in containers 1352 and 1354. Containers 1352 and 1354 are constructed so as to be capable of withstanding 100 psi or better and are each formed with their upper ends closed off by top 1334. Valves 1362 and 1364 are suitably connected proximate upper portions of containers 1352 and 1354. A tube 1366 connects valve 1362 to one side of a "T" fitting 1370 another side of which is connected by a tube 1372 to valve 1374. The leg of "T" fitting 1370 connects to a regulator or regulating valve 1374 that closes off and regulates the flow of gas from a compressed air or gas cylinder 1380. A suitable and appropriate supply of compressed air or gas, such as $CO_2$, nitrogen or the like, is disposed in cylinder 1380 under pressure between 1,000 psi to 2,000 psi. A fill valve 1382 is carried by cylinder 1380 for use in replenishing the supply of gas or air therein. The quantity of air or gas in cylinder 1380 is such as to be sufficient to empty liquid 1360 from both containers 1352 and 1354. Regulator or regulator valve 1374 is selected to adjust cylinder 1380 pressure to a desired working pressure for liquid 1360 preferably to about 40 pis. "T" fitting 1370 is of conventional construction and selected to split the gas or air exiting cylinder 1380 into two separate streams, one for fluid container 1352, the other for container 1354. Valves 1362, 1364 are also of conventional construction and may be either one-way type valves or electrically operated shut-off valves electrically connected by suitable conductive wires to a terminal of a relay 1392 also disposed in unit 1302. Relay 1392 is of conventional construction and is electrically connected to the described components as described above for relays 792 and 1092 respectively of the embodiments of FIGS. 8, 9 and 10.

A tube 1394 extends from a suitable opening provided at the bottom of cylinder 1352 to a nozzle 1396 at the front end of unit section 1302. A tube 1398 extends from a suitable opening provided at the bottom of cylinder 1354 to a similar nozzle 1396 also provided at the front end of unit 1302. Tubes 1394 and 1398 are of non-conductive material and of a length and diameter commensurate with the desired fluid flow through unit 1302. A pressure operated valve 1400 is disposed in-line for each tube 1394, 1398 proximate the ends thereof connected to nozzles 1396 to facilitate operation of stun gun 1300. Valves 1400 are of conventional construction and preferably set to operate and release conductive fluid 1360 at approximately 5–40 psi. Appropriate electrically conductive but insulated wiring connects the positive terminals of valves 1400 to terminaly relay 1392; while similar conductive wire connects the negative terminals of valves 1400 to the negative terminal of a 12 volt power supply preferably in the form of a battery 1410 disposed in grip 1330 of unit 1302. Such connections being made as shown for similar components in the FIGS. 8–10 embodiments.

Electrically conductive wire extends from one contact of switch 130 to electrically connect same to relay 1392; while electrically conductive wire also extends from the other contact of switch 1310 to another terminal of switch 1392; all these connecting being the same as for comparable components of FIGS. 8–10 embodiments. Thus, upon actuation of trigger 1312 the contacts of switch 1310 are closed and circuit completed through the terminals of relay 1392.

A pressure gauge 1430, of conventional construction and conventionally connected to gas/air cylinder 1380, is carried by unit 1302 to provide an indication of the pressure in cylinder 1380. A fluid level gauge 832, of conventional construction and conventionally connected to fluid containers 1352, 1354, is also carried by unit 1302 to provide an indication of the level of fluid 1360 in containers 1352, 1354.

A shoulder sling 1434 of suitable material is connected to unit 1302 to enable the weight of this handheld unit to be placed on a user's shoulders when not in use and otherwise disposed to minimize or prevent fatigue when stun gun 1300 is in use. The components of unit 1302 are enclosed in a case 1440 of pistol-like configuration and which is formed from non-conductive material such as nylon, plastic or the like which is of sufficient strength to enable unit 1302 to be used as a club, if necessary. A pair of points 1442, 1444 extend forward from a front face of unit 1302. An electrically conductive wire 1450, electrically connects point 1442 to terminal 1408 of battery 1410 and at the same time also connects fluid tube 1494 into the electrical circuit of battery 1410. An electrically conductive wire 1452, electrically connects point 1442 to a high output tower 1454 of a coil 1456 also disposed in unit 1302. Wire 1452 also connects fluid tube 1398 into the electrical circuit of battery 1410 and has an insulating cover to prevent high voltage from leaking through to any other components other than what it i to connect to.

Coil 1456 is of conventional construction and constitutes a high voltage source and may, for example, be an ignition coil of the type used in automobiles, capable of putting out 60,000 volts and used in conjunction with an electronic triggering device. An electrically conductive wire extends from a positive terminal of coil 1456 to a suitable terminal of relay 1392. An electrically conductive wire extends from a negative terminal of coil 1456 to a triggering device 1480. Device 1480 is of conventional construction and may be, for example, a magnetic or halls pickup device as utilized in automotive applications and equipped with a reluctor or triggering wheel turned by a small electric motor (not shown) or air pressure which sends pulses to a control unit (not shown) that, in turn, acts as a switching device for coil 1456. An electrically conductive wire extends from triggering device 1480 to negative post 1408 of battery 1410. All connections referred to for coil 1456, relay 1392 triggering device 1480 and to battery 1410 are made as described above for similar components for the embodiments of FIGS. 8–10.

Further electrically conductive wires extend from negative post 1408 of battery 1410 to negative connections provided for valves 1362, 1364 respectively. An electrically conductive wire 1500 extends from a positive terminal 1502 of battery 1410 to terminal 1428 of relay 1392 and includes an in-line fuse of 1503 conventional construction and electrical characteristics commensurate with the described electrical circuitry. A further electrically conductive wire electrically connects negative terminal 1408 of battery 1410 to a terminal of relay 1392. Still another electrically conductive wire electrically connects the terminal of relay 1392 to a positive connection of triggering device 1480. These connections are also made as for similar components of the stun guns of the embodiments of FIGS. 8–10.

It should be noted that fill plugs 1520, 1522 are provided for fluid containers 1352 and 1354, respectively, to facilitate filling same with conductive fluid 1360.

The electrical circuitry, component selection, disposition and mounting are such that the high voltage produced in the respective components is prevented from grounding both internally and externally. Thus, fluid containers 1352, 1354 are insulated from each other and from other components in conventional ways and by conventional means. Fluid tubes 1394, 1398 are likewise constructed from non-conductive material, insdulated from each other and from other components; except those connected to them to act upon the fluid 1360 as it passes therethrough and has electrical charge imparted to it. The high voltage source 1456 and wires carrying high voltage are also especially well insulated to prevent leakage to other components. If necessary, diodes may be utilized to keep electrical current flowing in only one direction. Valves 1362, 1364 and 1400, if electrically operated, have their respective electrical components insulated from parts that come in contact with or may come in contact with fluid 1360. The body of backpack 706 and unit 1302 also are to be made from non-conductive materials to insulate components from each other and from the person using stun gun 1300.

Actuation of trigger 1312 closes the contacts of switch 1310 and activates a magnetic coil 1530 with relay 1392 connecting terminals of relay 1392. Valve 1374 is operated to release air/gas pressure from cylinder 1380 through tubes 1366 and 1372 respectively and upon actuation of valves 1362, 1364 to apply pressue to fluid 1360 within fluid cylinders 1352, 1354. Fluid 1360, now under pressure flows through tubes 1394, 1396 and with valves 1400 operated through nozzles 1396 in respective streams. The high voltage from battery 1410 through triggering device 1480 and coil 1456 is applied to the fluid streams and upon impinging upon a person and completing an electrical path thereon acts to stun the person. If fluid 1360 is used up, application of points 1442, 1444 against a person will also apply the generated high voltage to them to stun them.

Figure 12:
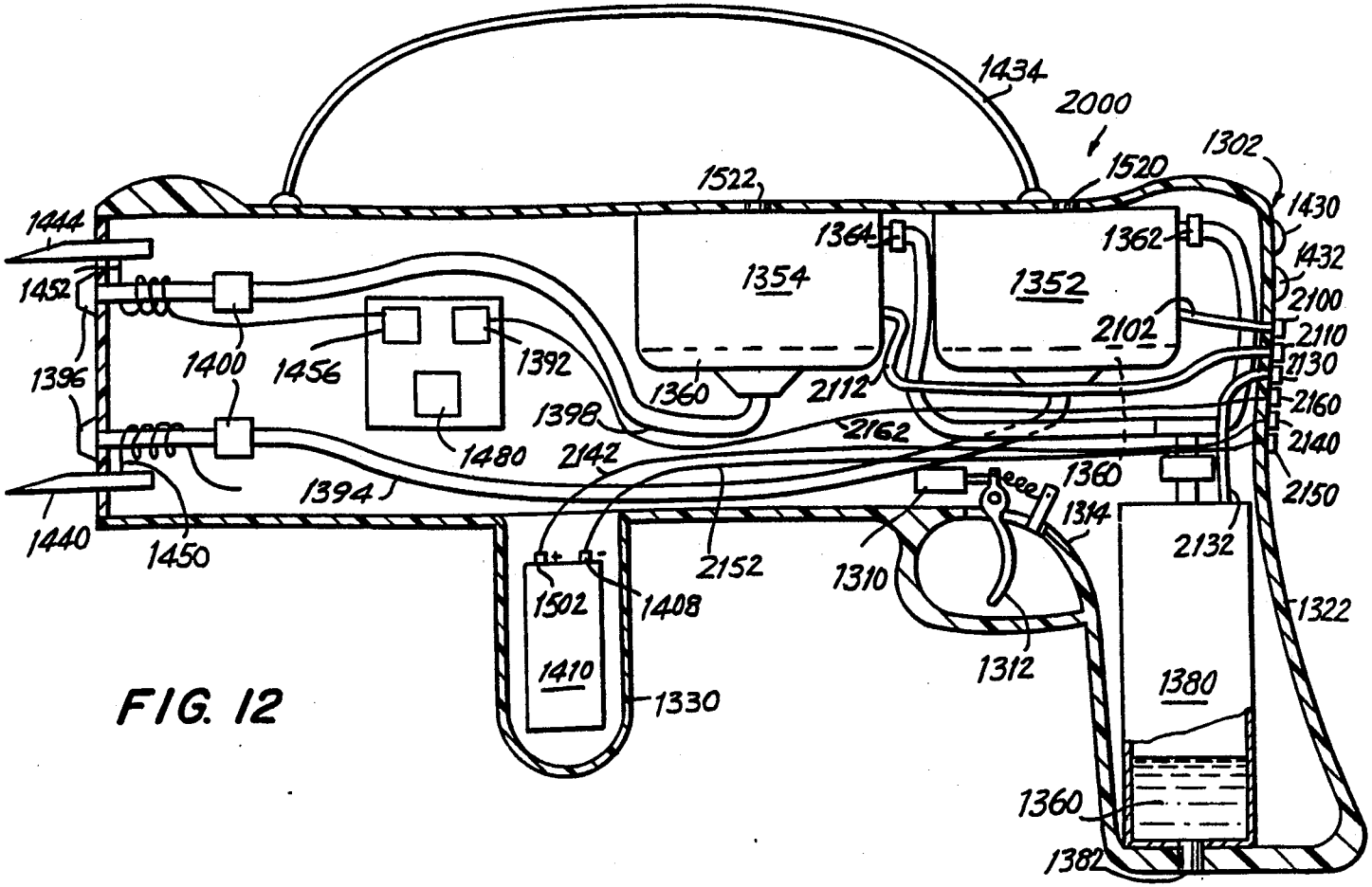
FIG. 12 is a side schematic cutaway view of still another alternative embodiment of stun gun incorporating the instant invention showing its internal components and in the form of a self-contained hand-held unit but one which may also be utilized with the backpack of FIG. 10.

In FIG. 12, there is shown an alternative embodiment of stun gun 2000 substantially identical to stun gun 1300 of FIG. 11 in that it includes a substantially hollow body unit 1302 including a handle 1322 and grip 1330. Fluid containers 1352 and 1354 are disposed within unit 1302, are filled with conductive fluid 1360 as for stun gun 1300 of FIG. 10, and are connected by tubes to an air/gas container 1380 as for stun gun 1300 of FIG. 10. Tubes extend from container 1352, 1354 to nozzles 1396 at the face of gun 2000, which face is also equipped with points 1442, 1444; all as for and for the same purposes as comparable components of stun gun 1300 of FIG. 10.

Gun 2000 also houses a power supply 1410 in the form of a battery, a relay 1392, a coil 1456 and a triggering device 1480; all of the same construction and characteristics as similarly numbered components of stun gun 1300 of FIG. 10; all similarly electrically connected and all functioning in the same manner as comparable components of stun gun 1300 of FIG. 10. The respective fluid and air/gas containers are connected together through tubes and with valves as are comparable components for gun 1300 (FIG. 10), and activated through a switch 1310 (FIG. 11) by a trigger 1312 constructed, connected and operated as their similarly numbered components of gun 1300 (FIG. 10).

Stun gun 2000 (FIG. 12) is, however, equipped with a set of quick disconnect plugs and fitting to facilitate connections between specific ones of its components and those of backpack unit 1006 of FIG. 10 to enchance and prolong operation of gun 2000 if desired.

A fitting 2100, disposed proximate handle 1322, connects to a tube 2102 leading into fluid container 1352 and is constructed to receive a comparable quick disconnect fitting when attached to tube 1094 of backpack unit 1006 (FIG. 10) to conduct fluid from fluid container 1052 into fluid container 1352. A fitting 2110 disposed proximate handle 1322, connects to a tube 2112 leading into fluid container 1354 and is constructed to receive a comparable quick disconnect filling when attached to tube 1098 of backpack unit 1006 (FIG. 10) to conduct fluid from fluid container 1054 into fluid container 1354.

A fitting 2130, also disposed proximate handle 1322, connects to a tube 2132 leading in air/gas contained 1380 and is constructed to receive a comparable quick disconnect fitting when attached to a tube 2134 (FIG. 10) connected to air/gas container 1080 to conduct air/gas therefrom to air/gas container 1380.

A quick disconnect electrical connector 2140 is electrically connected to an electrically conductive wire 2142 extending from terminal 1502 of battery 1410 and is connectable, through a suitable quick disconnect electrical connector, when carried by wire 1204 (FIG. 10), to battery 1110 of backpack unit 1006.

A quick disconnect electrical fitting 2160 (FIG. 11) is connected by suitable electrically conductive wire to a terminal of relay 1392 comparable to terminal 790 (FIG. 8) or 1090 (FIG. 9) and is connectable by a suitable quick disconnect electrical fitting to wire 1084 of backpack unit 1006 (FIG. 10).

Stun gun 2000 (FIG. 12) is operated in the same manner as stun gun 1300 (FIG. 11) but when connected as described above to the components carried in backpack unit 1006 is supplied with backup conductive fluid, air or gas and electrical power.

Stun guns 700 (FIG. 8) and 1300 (FIG. 11) may be modified by removing therefrom one of the respective two fluid containers and connected components to function with a single fluid stream. Stun guns 700 (FIG. 8) and 1300 (FIG. 11) may also be modified to have both a high voltage positive charge and a high voltage negative charge by suitable and appropriate rewiring of the negative tube and print to the high voltage output of the coil.

From the above description it will thus be seen that there has been provided new and improved electrical stun gun devices which devices are relatively simple in construction and operation and provide effective nonlethal anti-pressure weapons.

It will be understood that although I have shown preferred embodiments of my invention that various modifications may be made in the details thereof without departing from the spirit as comprehended by the following claims.

What is claimed is:

1. A conductive liquid for use in an antipersonnel weapon, comprising a mixture of water, graphite, NaCl and a conductive material, wherein said conductive material is semi-powdered silver.

2. The liquid according to claim 1 wherein said mixture is proportioned by volume with one cup of water, two teaspoons of graphite, $2\frac{1}{2}$ teaspoons of NaCl and $\frac{1}{4}$ teaspoon of semi-powdered silver.

* * * * *